US005704449A

United States Patent [19]

Ono

[11] Patent Number: 5,704,449

[45] Date of Patent: Jan. 6, 1998

[54] SCAFFOLDING PLANKS

[76] Inventor: Tatsuo Ono, 5-20-13, Matsugaoka, Funabashi, Chiba, Japan

[21] Appl. No.: 582,914

[22] Filed: Mar. 20, 1996

[30] Foreign Application Priority Data

Apr. 14, 1995 [JP] Japan ..... 7-113963
Jun. 23, 1995 [JP] Japan ..... 7-181135

[51] Int. Cl.[6] ..... E04G 3/10

[52] U.S. Cl. ..... 182/119; 182/222; 182/113

[58] Field of Search ..... 182/119, 222, 182/223, 113

[56] References Cited

U.S. PATENT DOCUMENTS 1,919,016 7/1933 Geer ..... 182/113
3,509,966 5/1970 Sarno ..... 182/119

FOREIGN PATENT DOCUMENTS 4-129256 11/1992 Japan .
1352697 5/1974 United Kingdom ..... 182/222
2056545 3/1981 United Kingdom ..... 182/113

*Primary Examiner*—Alvin C. Chin-Shue
*Attorney, Agent, or Firm*—McGlew and Tuttle

[57] ABSTRACT

A scaffolding plank for a framework scaffolding or a suspended scaffolding, which has its object to eliminate a clearance in all directions of the scaffolding plank and to detachably mount a stopper at the back of a hook on a lateral member with a one-touch control.

There is comprised of a horizontal plank body 6, a plurality of hooks 9, 10, 11, 12 provided at both front and rear ends of the plank body, a plurality of notches 13, 14*a*, 14*b*, 15, 16*a*, 16*b* likewise provided at both front and rear ends of the plank body, and a stopper mechanism S provided below each hook to be freely moved in and out, said front hook being provided on the same axis where the rear notch is provided, said rear hook being provided on the same axis where the front notch is provided.

11 Claims, 12 Drawing Sheets

SCAFFOLDING PLANKS

FIELD OF THE INVENTION

The present invention relates to scaffolding planks for a framework scaffolding, or scaffolding planks for a suspended scaffolding used for construction works such as plant construction, bridge construction and special construction.

The conventional framework scaffolding of this kind has been known from the disclosure of Japanese Utility Model Laid-Open No. 4(1992)-129256 publication.

BACKGROUND OF THE INVENTION

In this framework scaffolding, as shown in FIG. 12, frames 1, 1 provided in a plug-in manner in a longitudinal direction and a lateral member 2 mounted between the frames 1, 1 constitute a frame body 3, a number of the frame bodies 3 are placed in a row, after which scaffolding planks 4, 4 are mounted on the lateral member 2 through hooks H, baseboards 5, 5 are arranged in the neighborhood of the scaffolding planks 4, 4, and the baseboards 5, 5 are connected to the frames 1, 1 which double as upper handrails by means of wires or the like.

Further, a semicircular stopper which moves down by its own weight is vertically movably provided on the back of the hook H so that when the hook H is placed in engagement with the lateral member 2, the stopper falls, and the lateral member 2 is held by the hook and the stopper to prevent the scaffolding plank 4 from being floated.

On the other hand, in the suspended scaffolding used for the plant construction, bridge construction or painting work therefor, usually, the lateral member is hung down from top, the scaffolding plank 4 is mounted on the lateral member through the hook H as described above, and this scaffolding plank 4 is used to perform the construction work, painting work and the like.

However, the framework scaffolding and suspended scaffolding making use of the above-described conventional scaffolding planks have the following inconveniences.

Firstly, since the scaffolding planks 4, 4 are usually formed to be elongated in order to reduce the weight, even if a plurality of, for example, two scaffolding planks 4, 4 are mounted on the lateral member 2, a clearance would be unavoidably formed between the scaffolding planks 4, 4 and the baseboards 5.

Therefore, there exists a risk that nails, bolts, tools, small architectural materials, etc. on the scaffolding planks 4, 4 fall down through the clearance.

Secondly, the scaffolding planks 4, 4 are continuously disposed also lengthwise. In this case, however, each of the scaffolding planks 4, 4 is disposed by bringing the hooks H extended from both front and rear ends into engagement with the lateral member 2. Therefore, a clearance having a length for two hooks H would be formed between the scaffolding planks 4, 4 adjacent before and behind, giving rise to a risk that tools and the like on the scaffolding planks fall down in the same manner as described above.

Thirdly, since the baseboards are members separate from the scaffolding planks, it is necessary to mount and remove them separately from the scaffolding planks whenever necessary and the operation is troublesome.

Fourthly, stoppers in engagement with the lateral member 2 are provided to prevent the scaffolding plank 4 from being disengaged and floated upward. However, the operation of mounting and removing each stopper is troublesome and the workability is poor.

That is, in the case where there are a plurality of hooks H and stoppers, when they are unlocked, it is necessary to first remove one stopper and hook H and then remove other hook H and stopper. If an attempt is made to do this operation by a single operator, the stopper drops by its own weight to lock by itself. So, if an attempt is made to raise one stopper to release locking and then unlock the other stopper, the stopper previously unlocked falls by its own weight and again would become locked.

Accordingly, in the case where there are a plurality of hooks H and stoppers, it is necessary to simultaneously perform the unlocking operation by two operators or more.

Fifthly, since the stopper provided on the back of the hook is arranged below the scaffolding plank 4, it is difficult to lock or unlock the stopper. Especially, in the case of the suspended scaffolding, this operation involves a very dangerousness, and the operation from top is sometimes impossible depending on the place of the suspended scaffolding.

SUMMARY OF THE INVENTION

It is therefore a first object of the present invention to provide a scaffolding plank in which when a plurality of scaffolding planks are disposed in a row before and behind, a clearance is not formed between plank bodies adjacent to each other.

It is a second object of the present invention to provide a scaffolding plank in which a stopper provided below each hook can be detachably mounted on a lateral member with a one-touch control, and this detachable operation can be done by a single operator.

It is a third object of the present invention to provide a scaffolding plank in which a stopper can be locked or unlocked even from top of the scaffolding plank.

For achieving the aforementioned objects, according to the present invention, there is provided a scaffolding plank detachably mounted through hooks on a lateral member constituting a framework scaffolding or a suspended scaffolding, comprising a horizontal plank body, a plurality of hooks provided on both front and rear ends of the plank body, a plurality of notches likewise provided on both front and rear ends of the plank body, and a stopper mechanism provided below each hook so as to be freely moved in and out, the front hook being provided on the same axis where the rear notch is provided, the rear hook being provided on the same axis where the front notch is provided.

According to the above-described configuration, when the stopper is extruded, the lateral member of the framework scaffolding or the suspended scaffolding is held by the hooks and stoppers to prevent the plank body from being floated, and when the stoppers are forcibly moved back, the stoppers release the holding of the lateral member so that the plank body can be raised up.

Since the plurality of hooks and notches are provided on both front and rear ends of the plank body, the plank bodies can be disposed in a row before and behind through the hooks and notches.

In this case, since a position for fitting the front hook and a position of the rear notch are coincident with each other on the same line, when the rear scaffolding plank is disposed next to the front scaffolding plank, the front hook in the rear scaffolding plank can be moved into the notch in the front scaffolding plank. Therefore, no clearance is present in a joint between two front and rear scaffolding planks.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENTS

Figure 1:
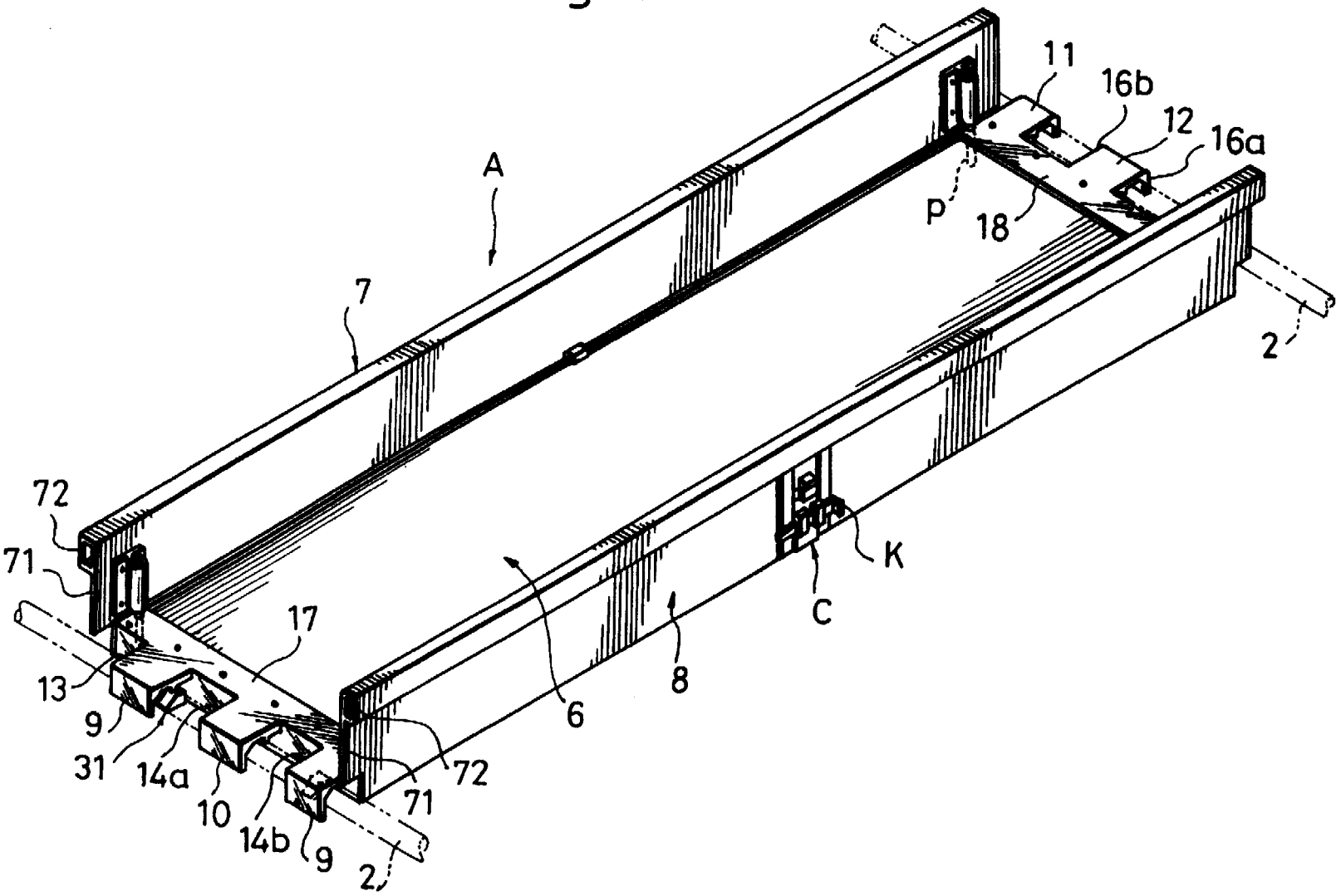
FIG. 1 is a perspective view of a scaffolding plank according to the present invention.

The embodiments of the present invention will be described hereinafter with reference to the drawings. FIG. 1 through FIG. 6 show scaffolding planks according to one embodiment of the present invention.

This scaffolding plank A comprises a horizontal plank body 6, two front hooks 9, 10 and rear hooks 11, 12 provided on both front and rear ends of the plank body 6, and left and right baseboards 7, 8 stood upright on both left and right sides of the plank body 6 and detachably mounted on the plank body 6 through a wedge mechanism C serving as a locking mechanism and a pin P mounted on the baseboard 7, 8. The pin P being insertable into a pinhole defined by the plank body 6. The wedge mechanism C is composed of a metal fitting which projects from the plank body 6 to the sides of the baseboards 7, 8 through an opening, and a wedge K detachably mounted on the metal fitting. The locking mechanism may be a type having no wedge.

The front end and the rear end of the plank body 6 are furnished with two notches 13, 14*a*, 14*b* and 15, 16*a*, 16*b*, respectively. The front notches 13, 14*a*, 14*b* are arranged on the same axis as the rear hooks 11, 12 lengthwise, and conversely, the rear notches 15, 16*a*, 16*b* are arranged on the axis as the front hooks 9, 10.

That is, the front and rear hooks 9, 10, 11, 12 and the front and rear notches 13, 14*a*, 14*b*, 15, 16*a*, 16*b* are alternately arranged.

Figure 13:
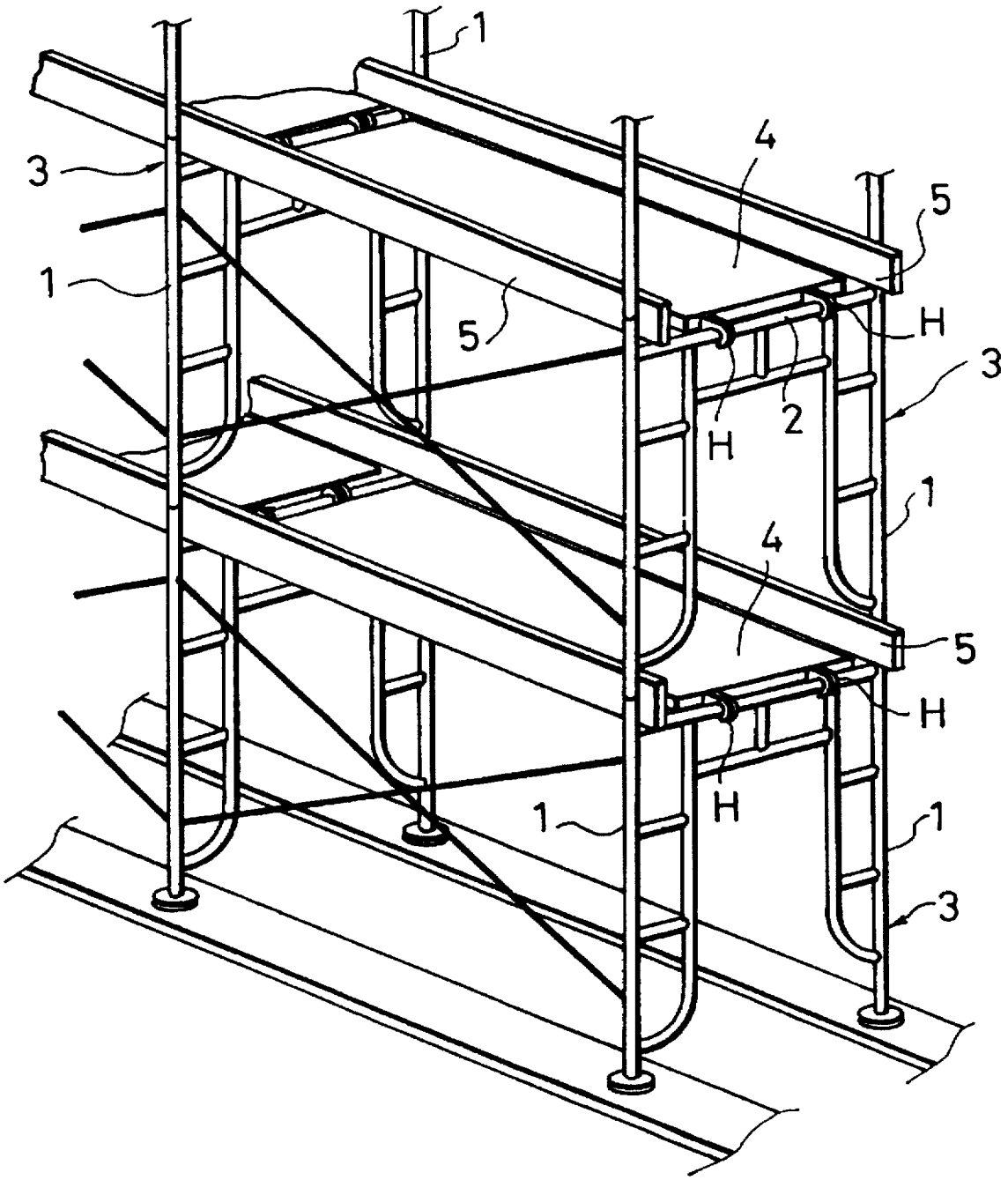
Fig.13 PRIOR ART
FIG. 13 is a perspective view of a conventional suspended scaffolding.

The scaffolding plank A is mounted on the lateral member 2 of the framework scaffolding through the hooks 9, 10, 11, 12 in the same manner as prior art, as shown in FIG. 13.

In this case, usually, two scaffolding planks A or more are laterally arranged in a row, but in the case of a scaffolding having a large lateral width of the plank body 6, only one will suffice.

Preferably, usually, anti-skid ribs and protrusions are provided on the upper surface of the plank body 6.

Since the baseboards 7, 8 are detachably connected to and integrated with the plank body 6, no clearance occurs therebetween to prevent nails, bolts and nuts, tools, small architectural materials, etc. on the plank body 6 from falling down.

Further, since the baseboards 7, 8 are integrally mounted and removed simultaneously with mounting and removing thereof relative to the framework scaffolding of the plank body 6, the workability is improved.

Figure 2:
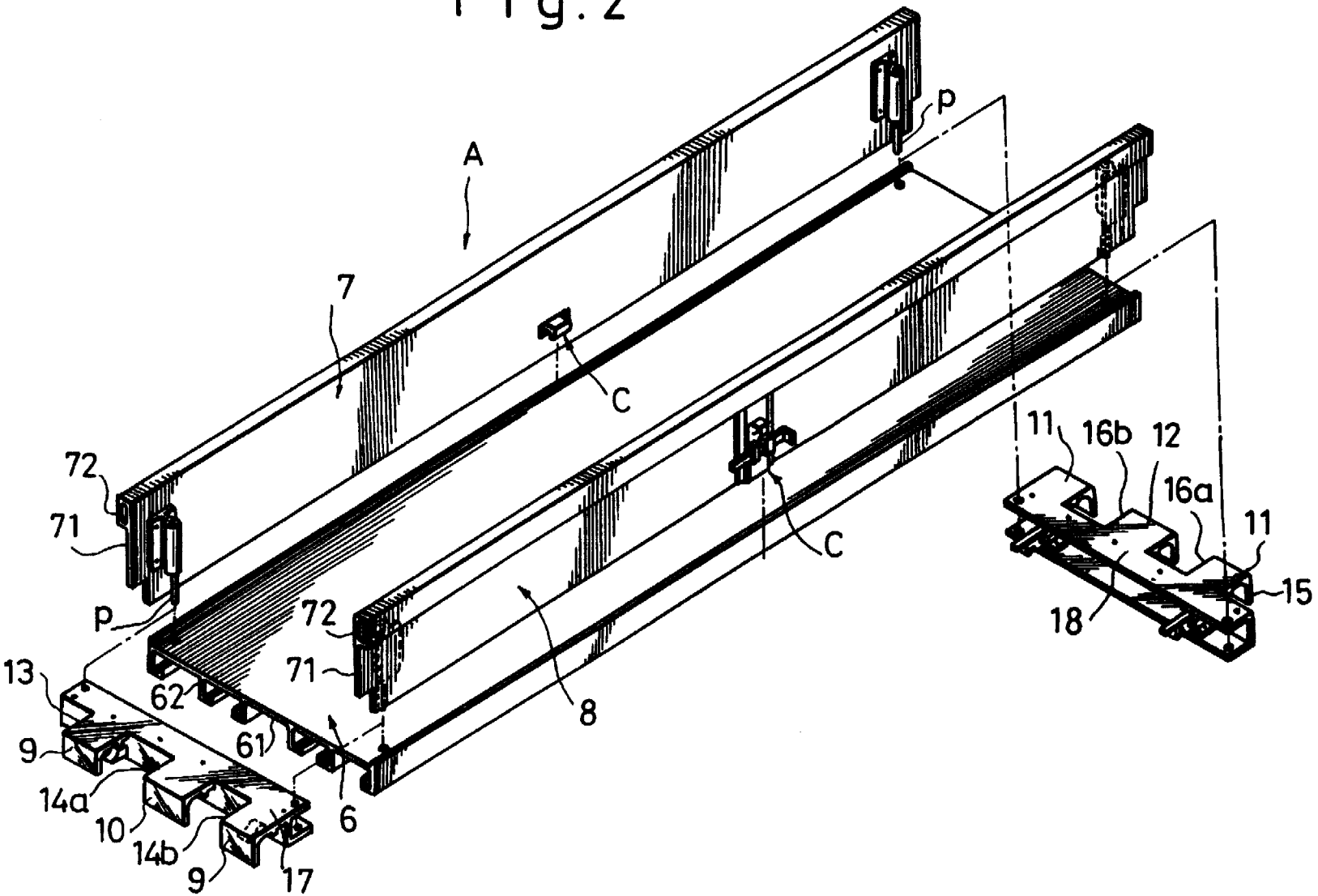
FIG. 2 is an exploded perspective view of the scaffolding plank shown in FIG. 1.

The hooks 9, 10, 11, 12 may be directly mounted before and behind of the plank body 6. However, as shown in FIG. 2, auxiliary plates 17, 18 having a U-shaped section are inserted in and secured to both the front and rear ends of the plank body 6, and each of the auxiliary plates 17, 18 is provided with the front and rear hooks 9, 10, 11, 12 and notches 13, 14*a*, 14*b*, 15, 16*a*, 16*b*.

The plank body 6 is composed of a plank 61 and an reinforcing frame 62 provided on the lower surface of the plank 61, and the baseboards 7, 8 are composed of a vertical frame 71 and a pillar 72 provided lengthwise on the vertical frame 71.

A number of the scaffolding planks A are placed in a row in a longitudinal direction on the lateral member 2 of the framework scaffolding. At this time, the front hooks 9, 10 of the scaffolding plank A arranged rearward are fitted into the rear notches 15, 16*a*, 16*b* of the scaffolding plank A arranged forward, and conversely, the rear hooks 11, 12 of the scaffolding plank A forward are fitted into the front notches 13, 14 of the scaffolding plank A rearward.

Consequently, ends between two scaffolding planks A, A adjacent front and behind can be placed in close contact with each other to prevent a clearance from occurrence in a junction therebetween and prevent nails, tools, etc. from falling.

As shown in FIGS. 3 through 6, a stopper mechanism S is provided to be freely moved in and out of the back of each of the hooks 9, 10, 11, 12.

The stopper mechanism S is composed of a hollow guide 30, a stopper 31 slidably inserted into the guide 30, coil springs 32, 32 serving as resilient members interposed between the guide 30 and the stopper 31 to bias the stopper in a hook direction, and a locating member 33 provided at the upper part or side of the guide 30 to hold the stopper 31 at a predetermined position against the resilient members.

In this case, the stopper 31 is composed of a rod body 34, a curved surface 35 formed in the upper part at the extreme end of the rod body 34, a grip portion 36 provided at the rear end of the rod body 34, and two grooves 37, 38 formed on the upper surface of the rod body 34.

The hollow guide 30 is formed by a tubular body 39 having a U-shaped section with the plank body bent, and the resilient members are composed of one or more coil springs 32 interposed between a bent extreme end 30*a* of the tubular body 39 and the body of the rod body 34, the coil spring 32 having one foot 32*a* connected to the extreme end 30*a* of the tubular body 39 and the other foot 32*b* fitted in and secured to the upper part or side of the rod body 34.

The locating member 33 is composed of a spring plate 40 having one end connected to an upper inflated portion of the tubular body 39 serving as a guide, a pin 41 extending through the spring plate 40 and having a lower end connected to the upper inflated portion of the tubular body 39, a coil spring 44 interposed between a flange at the upper end of the pin 41 and the upper surface of the spring plate 40 to bias the spring plate 40 downward, and a stop protrusion 42 provided on the lower surface of the spring plate 40 and selectively fitted into either of grooves 37, 38 on the side of the rod body 34.

Figure 3:
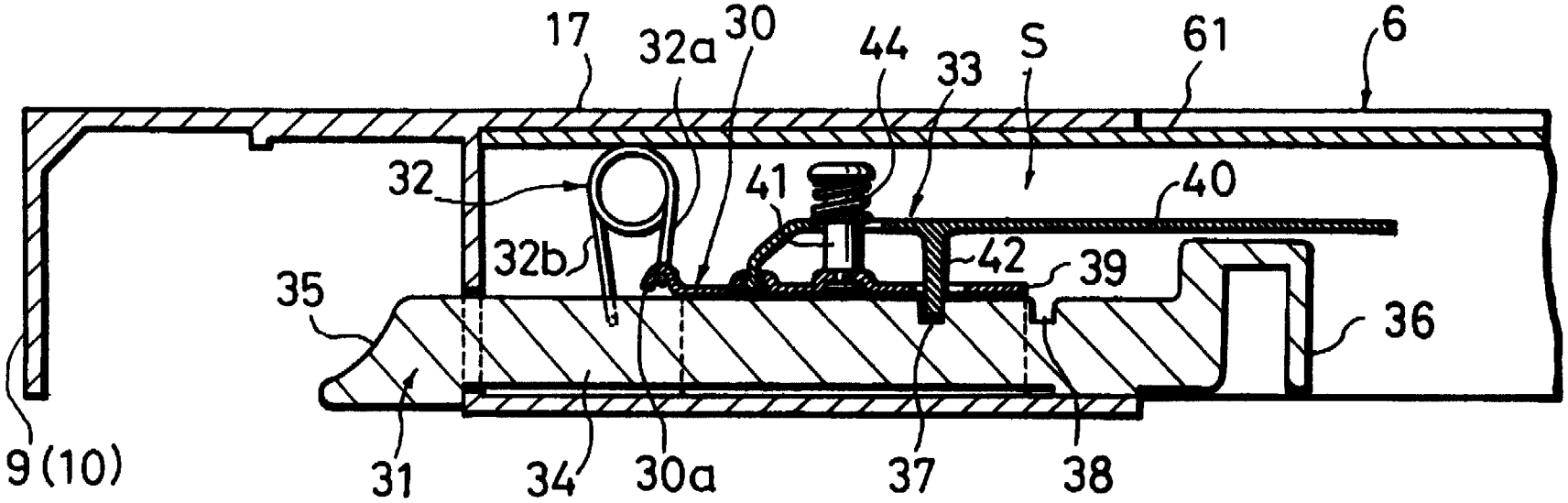
FIG. 3 is an enlarged sectional view of a stopper mechanism.
Figure 4:
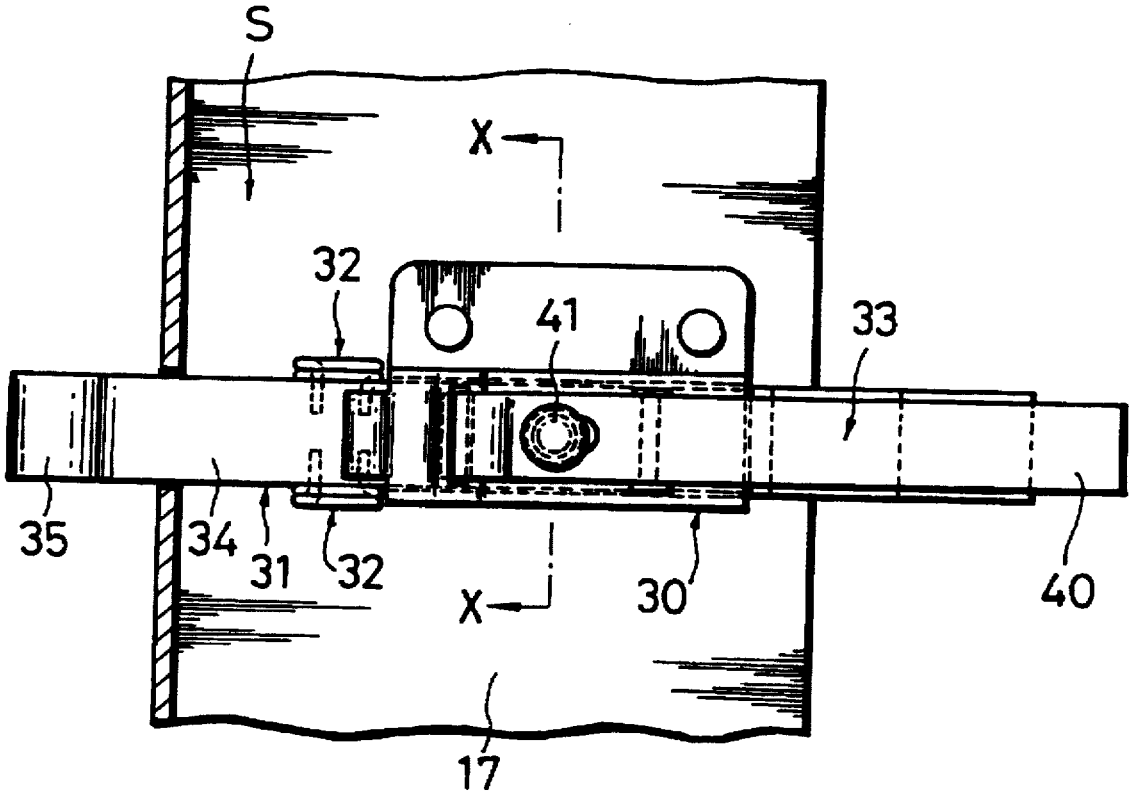
FIG. 4 is a plan view of a stopper mechanism.
Figure 5:
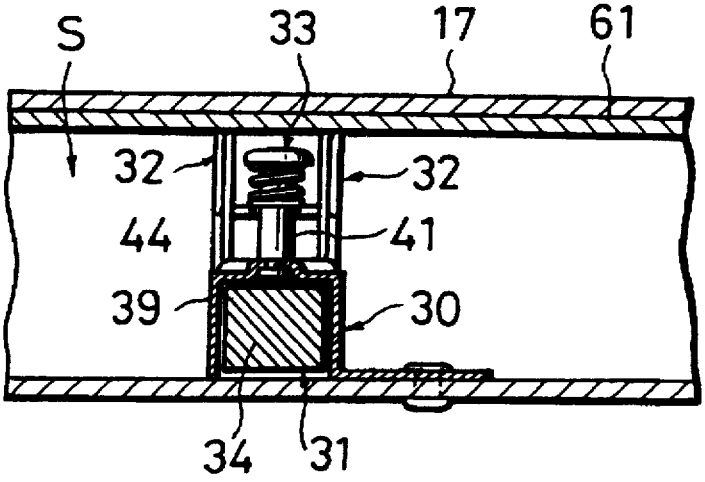
FIG. 5 is a sectional view taken on line X—X of FIG. 4.

In the neutral state, the stopper mechanism S is held at a position of FIG. 3.

In this state, the stop protrusion 42 is biased by the coil spring 41 and fitted into the front groove 37, the rod body 34 constituting the stopper 31 is at a withdrawn position, and a large downwardly-directed clearance is formed between the extreme end of the stopper 31 and the hooks 9, 10, 11, 12. In this state, the scaffolding plank A is placed in engagement with the lateral member 2 through the hooks 9, 10, 11, 12.

Figure 6:
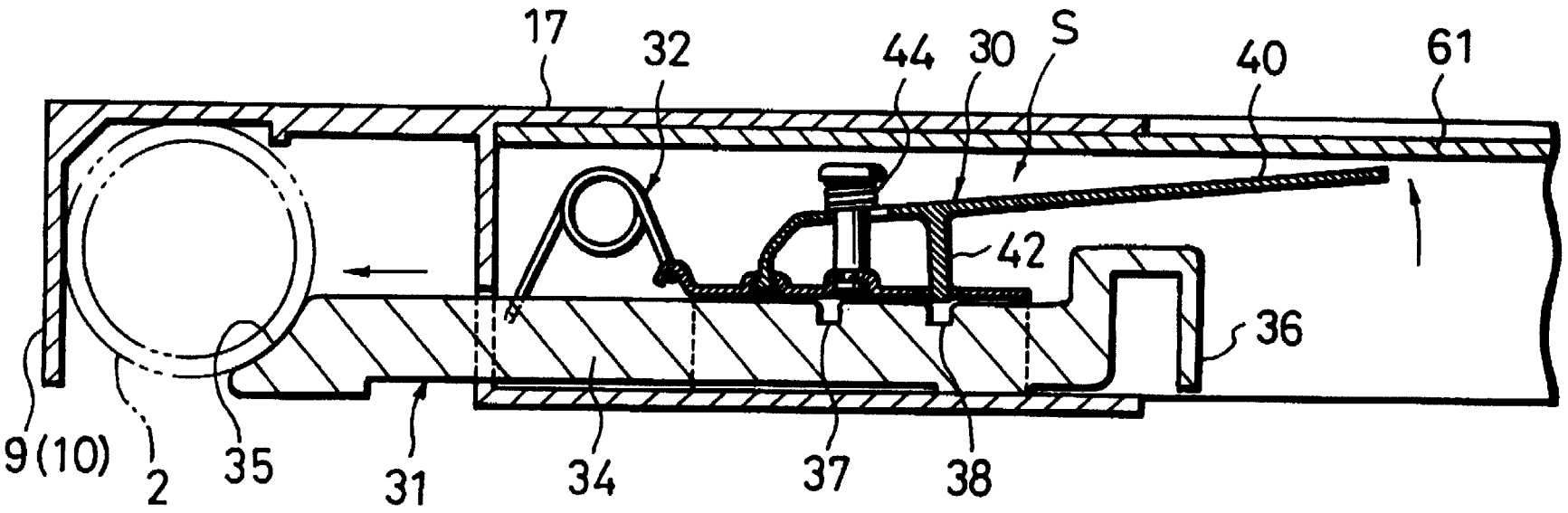
FIG. 6 is an enlarged sectional view showing the operating state of the stopper mechanism.

Next, when the spring plate 40 constituting the locating member 33 is raised up against the coil spring 41 as shown in FIG. 6, the stop protrusion 42 is slipped out of the groove 37. Accordingly, the rod body 34 is urged in a hook direction by the force of the coil spring 32 so that the curved surface 35 at the extreme end of the rod body 34 comes into contact with the lower surface of the lateral member 2, and the lateral member 2 is held, for example, by the hook 9 and the curved surface 35 to prevent the scaffolding plank A from being floated and slipping out. At this time, the stop protrusion 42 is fitted into the rear groove 38 to perform the location.

On the other hand, when the scaffolding plank A is removed from the lateral member 2, the spring plate 40 is first raised and then the grip portion 36 is pulled to withdraw the rod body 34 against the coil spring 32. Next, when the operation of raising the spring plate 40 is stopped, the spring plate 40 is moved down by the force of the coil spring 41, and the stop protrusion 42 is again fitted into the front groove 37. Accordingly, the rod body 34 serving as the stopper 31 is returned to its neutral state, and a large clearance occurs between the hook 9 and the extreme end of the rod body 34 so that the lateral member 2 is moved down through the clearance, that is, the scaffolding plank A is relatively raised up and removed.

In this case, even if there are a plurality of stoppers 31, each stopper 31 can be held at the withdrawn position by the locating member 33. Therefore, the next stopper 31 can be released while keeping one stopper 31 at the aforesaid state, and the entire operation is capable of being made by a single operator, cosequently.

Figure 7:
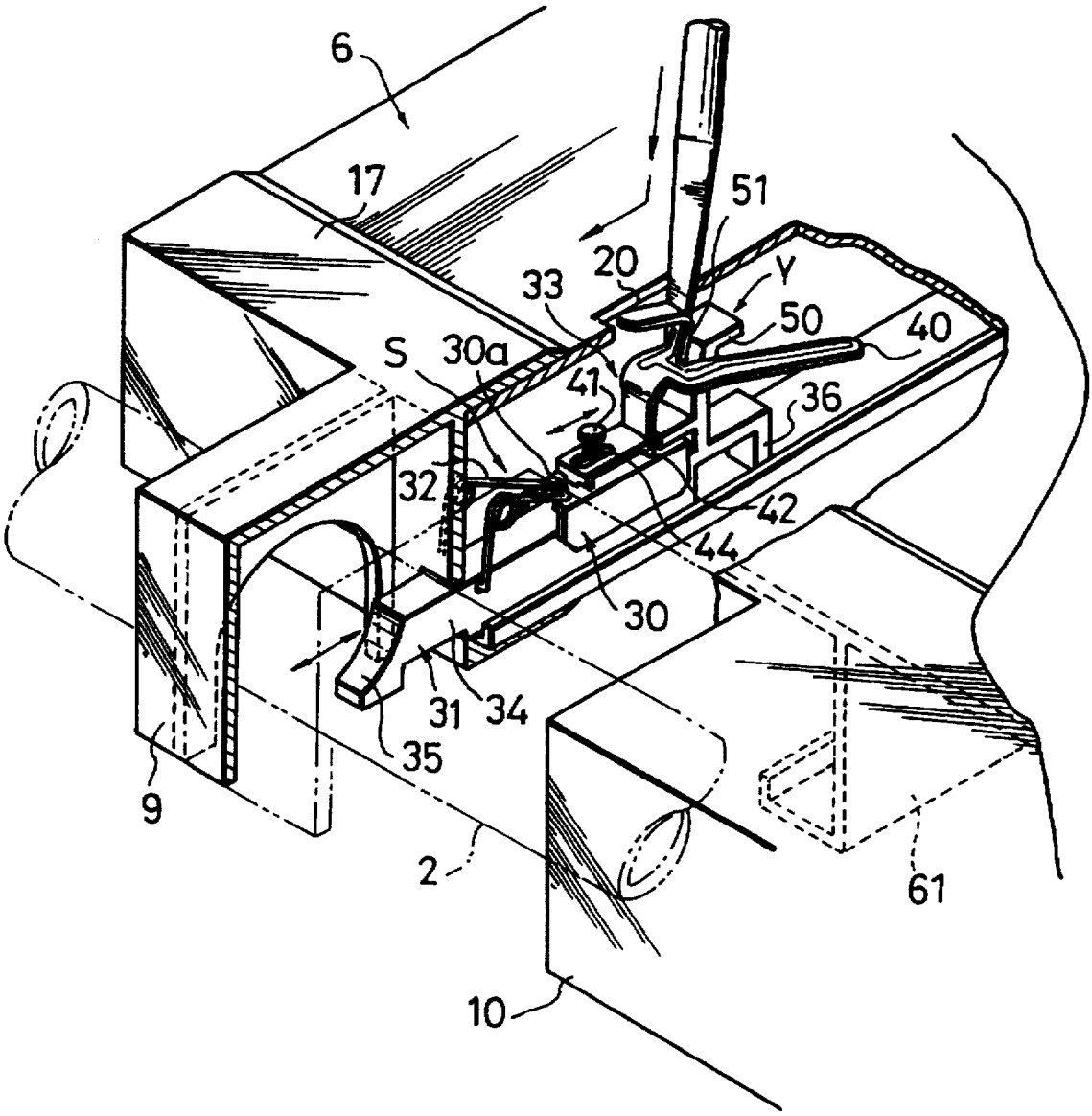
FIG. 7 is a partly cutaway perspective view of a scaffolding plank according to another embodiment of the present invention.
Figure 8:
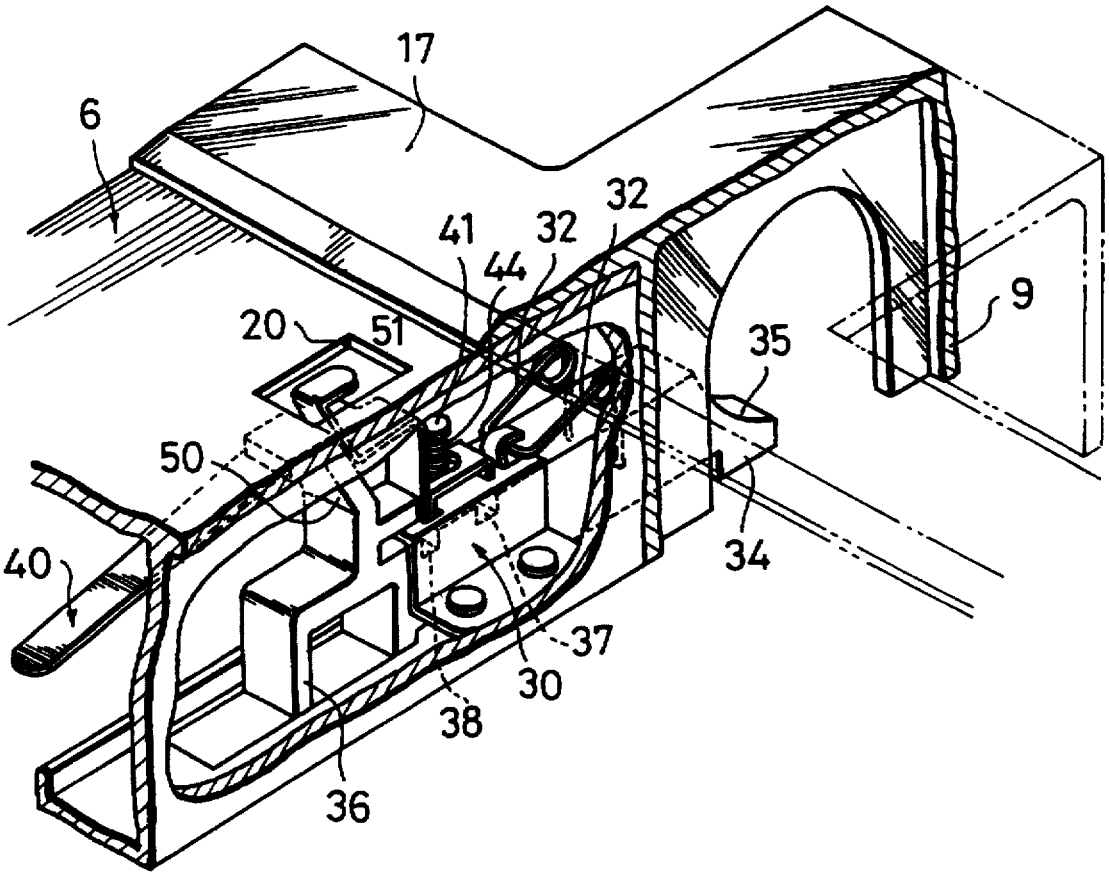
FIG. 8 is a partly cutaway perspective view of the scaffolding plank shown in FIG. 7 as viewed from a separate position.
Figure 9:
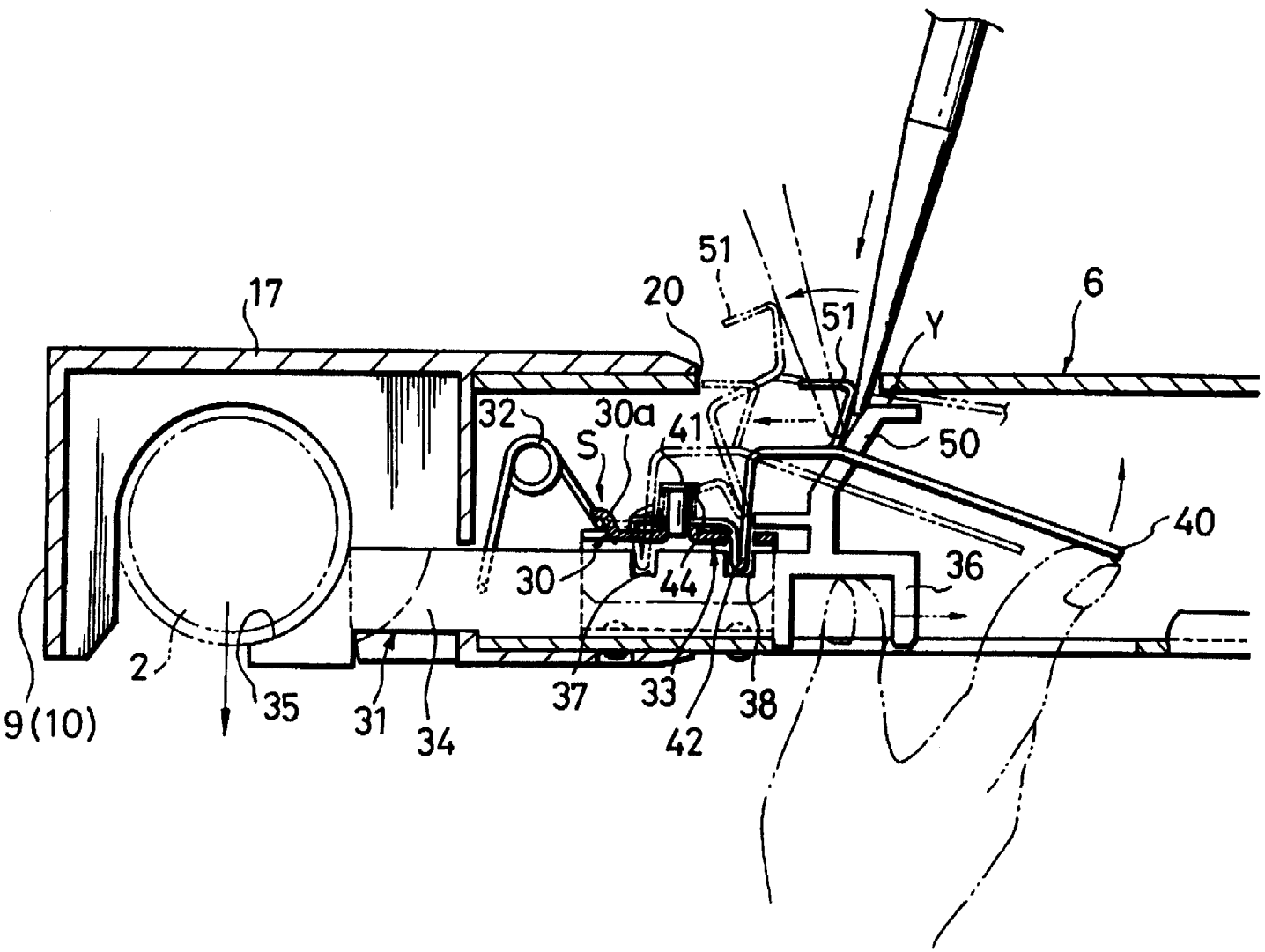
FIG. 9 is an enlarged sectional view of a stopper mechanism and an unlocking mechanism in FIG. 7.

FIGS. 7 through 9 show another embodiment of the present invention. The fundamental configuration of the scaffolding plank according to this embodiment is the same as that of the embodiment shown in FIG. 1. The scaffolding plank according to this embodiment is provided with an unlocking mechanism and an opening opposite to the unlocking mechanism, in addition to the stopper mechanism according to the embodiment shown in FIG. 1.

As shown in FIGS. 7 through 9, the stopper mechanism S is provided to be freely moved in and out below each of the hooks 9, 10, 11, 12.

The aforementioned stopper mechanism S is composed of a hollow guide 30, a stopper 31 slidably inserted into the guide 30, coil springs 32 serving as resilient members interposed between the guide 30 and the stopper 31 to bias the stopper in a hook direction, and a locating member 33 provided at the upper part or side of the guide 30 to hold the stopper 31 at a predetermined position against the resilient members.

In this case, the stopper 31 is composed of a rod body 34, a curved surface 35 formed at the upper extreme end of the rod body 34, a grip portion 36 provided at the rear end of the rod body 34, and two grooves 37, 38 formed on the upper surface of the rod body 34.

The hollow guide 30 is formed by a tubular body having a U-shaped section with the plank body bent, and the coil spring is interposed between a hook portion **30*a* provided on the guide 30 and the body of the rod body 34. That is, the coil spring 32 has one foot connected to the hook portion 30*a* at the extreme end of the tubular body and the other foot fitted in and secured to the upper part or side of the rod body 34**.

The locating member 33 is composed of a spring plate 40 having one end connected to an upper inflated portion of the tubular body serving as the guide 30, a pin 41 passing through the spring plate 40 and having a lower end connected to the upper inflated portion of the guide 30, a coil spring 44 interposed between a flange at the upper end of the pin 41 and the upper surface of the spring plate 40 to bias the spring plate 40 downward, and a bent stop protrusion 42 provided on the lower surface of the spring plate 40 and selectively fitted into either of grooves 37, 38 on the side of the rod body 34.

An unlocking mechanism Y is composed of a support 50 stood upright on the upper surface of the grip portion 36 and a lever 51 stood upright from the spring plate 40 and opposite to the support 50. A tool or a finger is inserted between the support 50 and the lever 51 from the opening 20. The rear end of the spring plate 40 extends rearward with the axial center deviated so as not to interfere with the support 50. The opening 20 is formed on the upper surface of the plank body 6 and opposed to the unlocking mechanism Y.

In the withdrawn state, the stopper mechanism S is held at a position as indicated by a dotted line of FIG. 9.

In this state, the stop protrusion 42 is fitted into the front groove 37, the rod body 34 constituting the stopper 31 is in the withdrawn position, and a large downwardly-directed clearance is formed between the extreme end of the stopper 31 and the hooks 9, 10, 11, 12. In this state, the scaffolding plank A is placed in engagement with the lateral member 2 through the hooks 9, 10, 11, 12.

Next, as shown in FIGS. 7 and 9, when a tool such as a screw driver is inserted between the support 50 and the extended member 51 from the opening 20 to raise the lever 51 while fulcruming the support 50, the spring plate 40 constituting the locating member 33 is raised against the coil spring 41 and the stop protrusion 42 is slipped out of the groove 37. Accordingly, the rod body 34 is urged in a hook direction by the force of the coil spring 32 so that the curved surface 35 at the extreme end of the rod body 34 comes into contact with the lower surface of the lateral member 2, the lateral member 2 is held, for example, by the hook 9 and the curved surface 35, and the scaffolding plank A is prevented from being floated and being slipped out. At this time, the stop protrusion 42 is fitted into the rear groove 38 to perform the location.

On the other hand, when the scaffolding plank A is removed from the lateral member 2, the tool is inserted between the support 50 and the lever 51 as described above to raise the spring plate 40. Then, the support 50 is forced rearward by the extreme end of the tool while fulcruming the lever 51 so that the rod body 34 is moved back against the coil spring 32 and moved to a position in which the stop protrusion 42 is opposed to the groove 38. In this state, when the operation of raising the spring plate 40 is stopped, the spring plate 40 is moved down by the force of the coil spring 44 and the stop protrusion 42 is again fitted into the front groove 37. Accordingly, the rod body 34 serving as the stopper 31 is returned to the withdrawal state so that a large clearance occurs between the hook 9 and the extreme end of the rod body 34, and the lateral member 2 is moved down through the clearance, that is, the scaffolding plank A is relatively raised and removed.

In this case, even if there are a plurality of stoppers 31, each stopper 31 can be held at the withdrawal position by the locating member 33. It is therefore possible to release the next stopper 31 while keeping the one stopper 31 at the aforesaid state. The entire operation can be done by a single operator.

Further, since the spring plate 40 has a plate portion extending rearward from the support 50, in the case where operation can be made from bottom of the scaffolding plank, for example, as in the framework scaffolding, the spring plate 40 can be raised by the finger as shown in FIG. 9, without using the tool, and the operation of withdrawing the grip portion 36 can be made.

Next, a still another embodiment will be described with reference to FIGS. 10 through 12.

This embodiment is the same as that shown in FIG. 7 in construction, operation and effect except that the spring plate 40 is horizontal and the construction of the unlocking mechanism is different. So, the same constructions are indicated by the same reference numerals, details of which are omitted.

Figure 10:
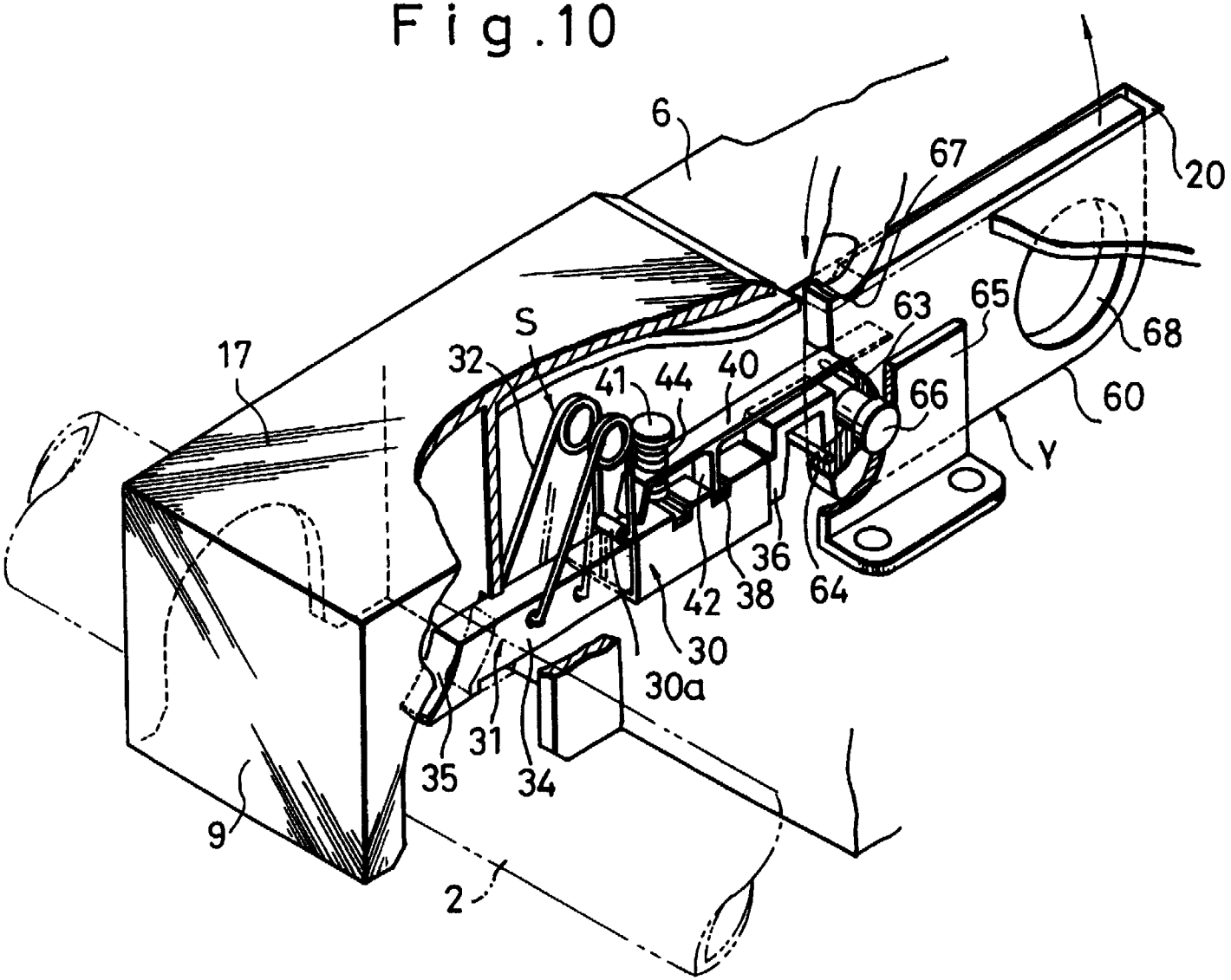
FIG. 10 is a partly cutaway perspective view of a scaffolding plank according to further another embodiment of the present invention.
Figure 11:
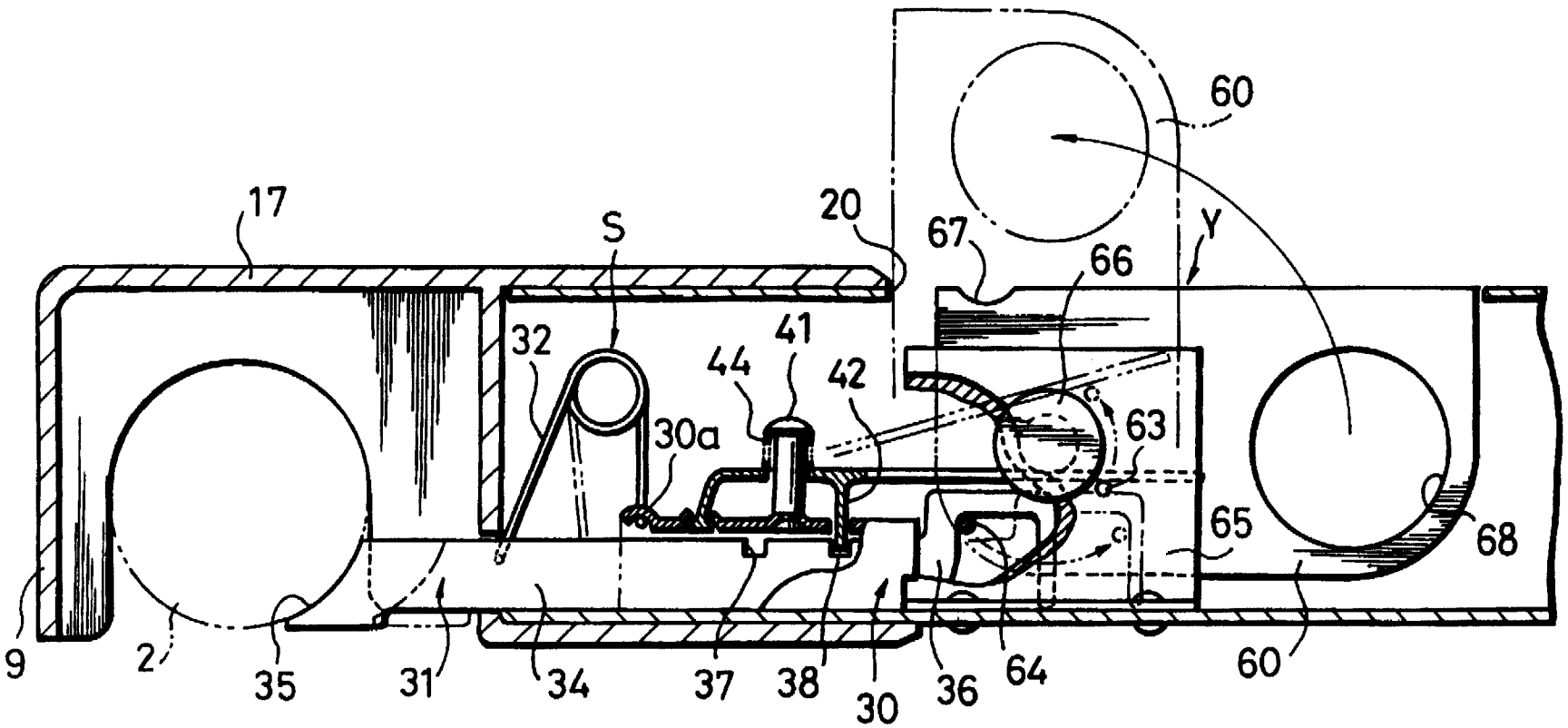
FIG. 11 is an enlarged sectional view of a stopper mechanism and an unlocking mechanism according to the embodiment shown in FIG. 10.
Figure 12:
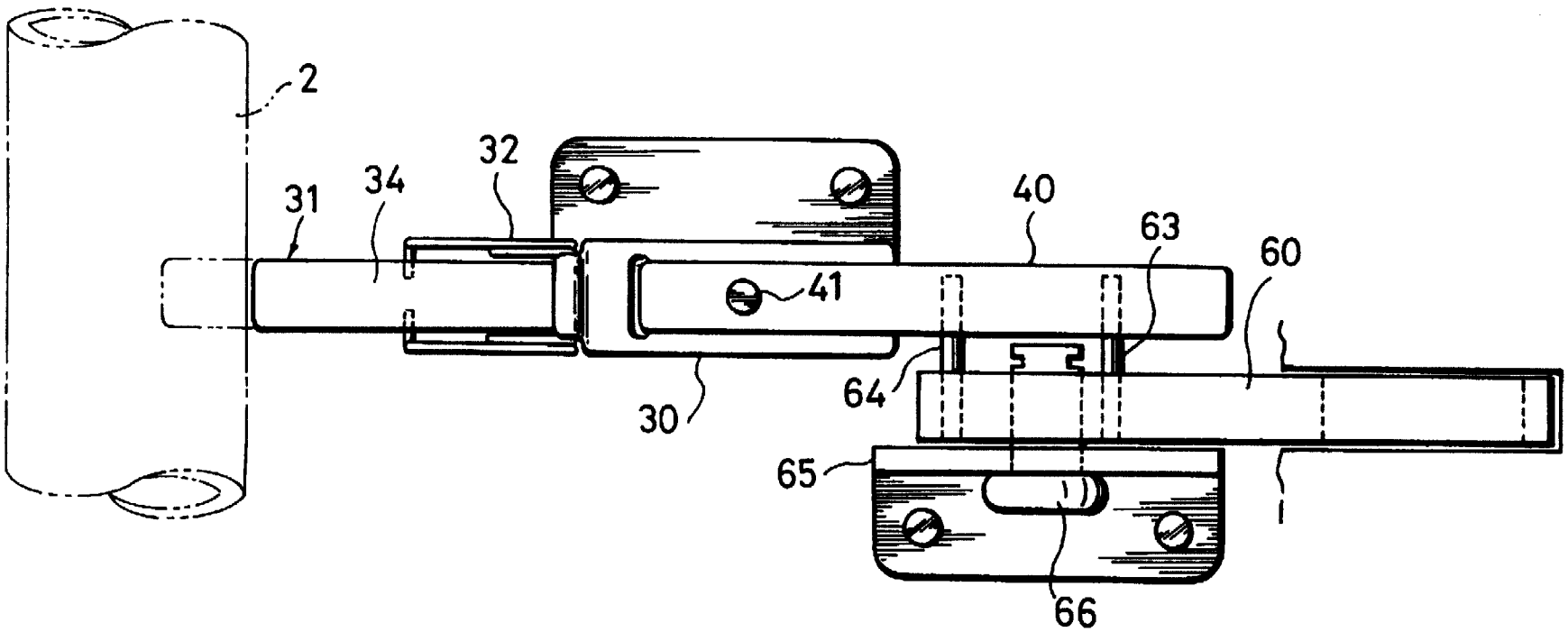
FIG. 12 is a plan view of the stopper mechanism and the unlocking mechanism.

That is, in the scaffolding plank A shown in FIGS. 10 through 12, a stopper 31 is composed of a rod body 34, a curved surface 35 formed in the upper part at the extreme end of the rod body 34, a grip portion 36 provided at the rear end of the rod body 34, and a groove 18 formed on the upper surface of the rod body 34; a locating member 33 is composed of a spring plate 40 composed of a horizontal plate having one end connected to the upper part of the guide 30, a spring 44 interposed between the spring plate 40 and the guide 30 to bias the spring plate 40 downward, and a stop protrusion 42 provided on the lower surface of the spring plate 40 to selectively fit into the groove 18; and an unlocking mechanism Y is composed of an arm 60 rotatably supported on the guide 30, and two first and second pins 63, 64 mounted at the extreme end of the arm 60, the first pin 63 being horizontally arranged opposite to the lower surface of the spring plate 40, the second pin 64 being horizontally arranged opposite to the grip portion 36, so that when in upward rotation of the arm 60, the first pin 63 causes the spring plate 40 to raise, and the second pin 64 is engaged with the grip portion 36 to withdraw the rod body 34.

The arm 60 is disposed on the support plate 65 stood upright on the reinforcing frame 62 to be rotatable about the shaft 66 and arranged parallel with the spring plate 40. The first and second pins 62, 63 provided on the arm 60 extend in the direction of the spring plate 40 and the grip portion 36. The grip portion 36 is formed to have a U-shaped section, and the second pin 64 is inserted into the grip portion 36.

The arm 60 is arranged opposite to the opening 20, the arm 60 being furnished with a depression 67 on the upper surface of its extreme end side and with a hole 68 at its rear portion.

FIGS. 10 and 11 show the locked state of the stopper mechanism S, in which case the rod body 34 extends and the stop protrusion 42 fits into the groove 38.

In this state, when the locking is released by the unlocking mechanism Y, a finger is inserted through the opening 20 to press the depression 67 downward, and the rear portion of the arm 60 is rotated upward while fleruming the shaft 66 as indicated by the arrow. Next, a hand is inserted into the hole 68 to erect the arm 60 upward by 90 degrees. At this time, the first pin 63 causes the spring plate 40 to raise to release the locking between the stop protrusion 42 and the groove 38, and further, the second pin 64 comes into engagement with the rear end of the grip portion 36 to pull it rearward and at the same time to pull the rod body 34 rearward. Accordingly, the rod body 34 does not any longer interfere with the lateral member 2, and therefore, when it is further raised through the hole 68 of the arm 60 by the hand or a tool, the scaffolding plank A can be removed from the lateral member 2.

On the other hand, when the scaffolding plank A is mounted on the lateral member 2, the rod body 34 is withdrawn in the same operation as that described above, under which state the hooks 9, 10, 11 and 12 are brought into engagement with the lateral member 2 and then the force of raising the arm 60 stops. Then the rod body 34 is extended in the direction of the lateral member 2 by the force of the coil spring 32, and the arm 60 also returns to a horizontal state, assuming a state of FIG. 10, that is, the locked state.

The present invention has the following effects:

① According to the inventions as claimed in each claim, since the stopper mechanism is provided below the hook, this stopper mechanism holds the lateral member to prevent the scaffolding plank from being floated. In this case, since the stopper mechanism is provided with the locating member, the scaffolding plank can be located to a position in which the former is engaged with the lateral member and cannot be slipped out and a position that can be slipped out whereby the operation of mounting and removing the scaffolding plank from the lateral member is improved, which operation can be made even by a single operator. Further, since the front hook and the rear notch are provided on the same axis and so are the front notch and the rear hook, when a plurality of scaffolding planks are disposed in a row, the hook in the rear scaffolding plank can be fitted in the notch in the front scaffolding plank, whereby no clearance occurs in the junction between the front and rear scaffolding planks to prevent nails, tools, etc. on the scaffolding planks from falling.

② Since the baseboards are detachably erected at both left and right ends of the plank body, there is no clearance between the plank body and the baseboards to prevent nails, bolts and nuts, tools, small architectural materials, etc. on the plank body from falling. Further, when the plank body is mounted, for example, on the lateral member of the framework scaffolding through the hooks, the baseboards are also simultaneously mounted. Therefore, the operation of mounting and removing the plank body from the baseboards is materially improved. Furthermore, since the baseboards can be detachably mounted, the baseboards can be separated when not in use, and they can be kept and conveyed while storing compactly.

③ Since the plank body is furnished with the opening opposite to the unlocking mechanism, a tool or a hand is inserted through the opening from top of the scaffolding plank to perform the operation of locking and unlocking the unlocking mechanism whereby the operation of assembling and disassembling the suspended scaffolding and framework scaffolding in which no clearance is present between the scaffolding planks can be performed even on top of the scaffolding plank, thus improving the workability.

④ Since there are provided the stopper mechanism and the unlocking mechanism next thereto, the plank body is held on the lateral member by the stopper mechanism to prevent the plank body from slipping out, and when the locking is released through the unlocking mechanism, the plank body can be removed, thus providing the smooth assembling and disassembling operation. While specific embodiments of the invention have been shown and described in detail to illustrate the application of the principles of the invention, it will be understood that the invention may be embodied otherwise without departing from such principles.

What is claimed is:

1. A scaffolding plank detachably mounted through hooks on a lateral member constituting a framework scaffolding or a suspended scaffolding, comprising a horizontal plank body, a plurality of hooks provided on both front and rear ends of the plank body, a plurality of notches likewise provided on both front and rear ends of the plank body, and a stopper mechanism provided below each hook to be freely moved in and out, the stopper mechanism includes a hollow guide, a stopper slidably inserted into the guide, resilient members interposed between the guide and the stopper to bias the stopper in a hook direction, and a locating member provided at the upper part or side of the guide to hold the stopper at a predetermined position against the resilient members; baseboards erected at both left and right ends of the plank body, said baseboards being detachably held on the plank body through a locking mechanism, the front hook being provided on the same axis where the rear notch is provided, the rear hook being provided on the same axis where the front notch is provided.

2. A scaffolding plank according to claim 1, wherein the stopper is composed of a rod body, a curved surface formed at the upper extreme end of the rod body, a grip portion provided at the rear end of the rod body, and two grooves formed on the upper surface of the rod body.

3. A scaffolding plank according to claim 1, wherein the hollow guide is a tubular body, and the resilient members are composed of one or more coil springs interposed between an extreme end of the tubular body and a rod body, said coil spring having one foot connected to the extreme end of the tubular body and the other foot secured to the upper part or side of the rod body.

4. A scaffolding plank according to claim 1, wherein the locating member is composed of a spring plate having one end connected to an upper portion of the guide, a pin passing through the spring plate and having a lower end connected to the upper portion of the guide, a coil spring interposed between the upper end of the pin and the upper surface of the spring plate to bias the spring plate downward, and a stop protrusion provided on the lower surface of the spring plate and selectively fitted into either of grooves on the side of the rod body.

5. A scaffolding plank according to claim 1, wherein an unlocking mechanism provided next to the stopper mechanism and an opening formed on the upper surface of the plank body and opposite to said unlocking mechanism are provided, said unlocking mechanism being operated by a tool inserted through the opening from top of the plank body to release the locking of the stopper mechanism for moving in and out the stopper mechanism.

6. A scaffolding plank according to claim 5, wherein the stopper is composed of a rod body, a curved surface formed at the upper extreme end of the rod body, a grip portion provided at the rear end of the rod body, and two grooves formed on the upper surface of the rod body; the locating member is composed of a spring plate having one end connected to an upper portion of the guide, a spring interposed between the spring plate and the guide to bias the spring plate downward, and a stop protrusion provided on the lower surface of the spring plate and selectively fitted into either of said two grooves; and the unlocking mechanism is composed of a support erected on the upper surface of said grip portion, and a lever erected from said spring plate and opposite to said support.

7. A scaffolding plank according to claim 5, wherein the stopper is composed of a rod body, a curved surface formed at the upper extreme end of the rod body, a grip portion provided at the rear end of the rod body, and grooves formed on the upper surface of the rod body; the locating member is composed of a spring plate having one end connected to an upper portion of the guide, a spring interposed between the spring plate and the guide to bias the spring plate downward, and a stop protrusion provided on the lower surface of the spring plate and selectively fitted into said grooves; and the unlocking mechanism is composed of an arm rotatably supported on the guide, and two first and second pins mounted on the arm, said first pin being horizontally arranged opposite to the lower surface of the spring plate, said second pin being horizontally arranged opposite to the grip portion, whereby when the arm is rotated upward through the opening, the first pin causes the spring plate to raise, and the second pin comes in engagement with the grip portion to withdraw the rod body.

8. A plank in accordance with claim 1, further comprising:

a plurality of pin holes defined by said plank body;

a plurality of pins mounted on said baseboards and insertable into respective said pin holes for detachably mounting said baseboards to said plank body.

9. A scaffolding plank comprising;

a plank body having opposite first and second ends;

a plurality of hooks positioned on said first and second ends of said plank body, said plurality of hooks being detachably mountable on a lateral member of a scaffolding;

stopper means associated with each of said plurality of hooks, said stopper means selectively blocking and unblocking an opening of said each hook, each said stopper means including a hollow guide, a stopper slidably mounted in said hollow guide, resilient means connected to said stopper for biasing said stopper into a first position to block said opening of said each hook, and locating means mounted on said hollow guide and for selectively fixing said stopper in a second position unblocking said opening of said each hook, said stopper is formed of a rod body having a first and second ends, a curved surfaced formed at said first end of said rod body, a grip portion formed at said second end of said rod body, said rod body defining first and second grooves on an upper surface of said rod body.

10. A plank in accordance with claim 9, wherein: said each locating means interacts with respective said first and second grooves.

11. A plank in accordance with claim 9, further comprising:

a baseboard perpendicularly mounted to said plank body;

a pin hole defined by said plank body;

a pin mounted on said baseboard and insertable into said pin hole for detachably mounting said baseboard to said plank body.

* * * * *